US008012312B2

(12) United States Patent
Goto et al.

(10) Patent No.: US 8,012,312 B2
(45) Date of Patent: Sep. 6, 2011

(54) CELLULOSE-BASED FIBROUS MATERIALS

(75) Inventors: Shisei Goto, Tokyo (JP); Takaharu Noda, Tokyo (JP); Chie Yuzawa, Tokyo (JP); Takeshi Iimori, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 219 days.

(21) Appl. No.: 12/297,736

(22) PCT Filed: Apr. 23, 2007

(86) PCT No.: PCT/JP2007/058750

§ 371 (c)(1),
(2), (4) Date: Oct. 20, 2008

(87) PCT Pub. No.: WO2007/123229

PCT Pub. Date: Nov. 1, 2007

(65) Prior Publication Data

US 2009/0065164 A1 Mar. 12, 2009

(30) Foreign Application Priority Data

| | | |
|---|---|---|
| Apr. 21, 2006 | (JP) | 2006-118450 |
| Aug. 9, 2006 | (JP) | 2006-217511 |
| Dec. 29, 2006 | (JP) | 2006-356885 |

(51) Int. Cl.
*D21G 1/00* (2006.01)

(52) U.S. Cl. ..... 162/231

(58) Field of Classification Search ..... 162/135, 162/145, 164.1, 164, 168.1, 169, 183
See application file for complete search history.

(56) References Cited

U.S. PATENT DOCUMENTS

| | | | | |
|---|---|---|---|---|
| 4,609,431 | A * | 9/1986 | Grose et al. | 162/135 |
| 7,727,355 | B2 * | 6/2010 | Goto et al. | 162/4 |
| 2007/0137804 | A1 | 6/2007 | Goto et al. | |

FOREIGN PATENT DOCUMENTS

| | | | |
|---|---|---|---|
| GB | 1 329 409 | | 9/1973 |
| GB | 1 397 308 | | 6/1975 |
| JP | 49-013403 | | 2/1974 |
| JP | 49-055908 | | 5/1974 |
| JP | 2004-530529 | | 10/2004 |
| SU | 720085 | * | 3/1980 |
| WO | WO 01/87471 | A2 | 11/2001 |
| WO | WO 01/87471 | A3 | 11/2001 |
| WO | 2005/012632 | | 2/2005 |

OTHER PUBLICATIONS

SU 720085, translation, Mar. 1980.*
Extended European Search Report in EP 07 74 2185 dated Mar. 24, 2009.
Official Action in EP 07 742 185.7 dated Feb. 15, 2010.
International Search Report for PCT/JP2007/058750, mailed Aug. 7, 2007.

* cited by examiner

*Primary Examiner* — Mark Halpern
(74) *Attorney, Agent, or Firm* — Nixon & Vanderhye P.C.

(57) ABSTRACT

The present invention aims to provide cellulose-based fibrous materials for obtaining papers and sheets having low density, high surface quality, good size stability despite of high strength, and high opacity. Cellulose-based fibrous materials having external fibrils consisting of an assembly of scale-like microfibrils exhibit a higher fiber stiffness, a lower water retention value and a higher specific surface area as compared with fibrous materials having filamentous external fibrils at the same freeness. Papers and sheets having low density, high surface quality, good size stability and high opacity can be obtained by using such fibrous materials.

11 Claims, 6 Drawing Sheets

Relationship between freeness and water retention value

Relationship between breaking length and post-immersion elongation

CELLULOSE-BASED FIBROUS MATERIALS

This application is a 371 of PCT/JP2007/058750 filed on 23 Apr. 2007

This application is the U.S. national phase of International Application No. PCT/JP2007/058750, filed 23 Apr. 2007, which designated the U.S. and claims priority to Japanese Application No(s). 2006-118450, filed 21 Apr. 2006, 2006-217511, filed 9 Aug. 2006 and 2006-356885, filed 29 Dec. 2006, the entire contents of each of which are hereby incorporated by reference.

TECHNICAL FIELD

The present invention relates to wood or non-wood cellulose-based fibrous materials for obtaining papers and sheets having low density, high surface quality, good size stability despite of high strength, and high opacity.

BACKGROUND ART

Recently, there are growing demands for bulky and light paper from the viewpoint of resource saving or physical distribution cost reduction and addition of high values such as quality appearance or massive appearance. Previously, various methods for improving bulk have been attempted.

For example, the following methods have been proposed: (1) using crosslinked pulp (JPA No. Hei 4-185791 (patent document 1), JPA No. Hei 4-202895 (patent document 2), etc.), (2) mixing synthetic fibers into pulp (JPA No. Hei 3-269199 (patent document 3), etc.), (3) filling inorganic materials between pulp fibers (JPA No. Hei 3-124895 (patent document 4), etc.), (4) adding void-inducing foaming particles (JPA No. Hei 5-230798 (patent document 5), etc.), (5) adding lightly beaten pulp fibers (JPA No. Sho 58-24000 (patent document 6), etc.), (6) including a soft calendering process (JPA No. Hei 4-370293 (patent document 7), etc.), (7) adding bulking chemicals (JPA No. Hei 11-350380 (patent document 8), etc.), (8) mercerization of pulp (JPA No. Hei 7-189168 (patent document 9), etc.), (9) enzymatic treatment of pulp (JPA No. Hei 7-54293 (patent document 10), etc.), etc.

However, these methods had disadvantages such as failure to recycle pulp; a significant decrease in paper strength or stiffness due to the inhibition of bonding between fibers; an unavoidable cost increase due to the addition of different types of chemicals or fillers to pulp; inevitable fresh problems including increased foams or sizing loss during papermaking processes, etc.

According to a book of Oe et al. (non-patent document 1), beating and refining are defined as a mechanical treatment of pulp performed by passing a pulp suspension through a relatively narrow gap between a rotor and a stator, the former rotating and the latter stationary in the presence of water.

Methods for the mechanical treatment include using equipments having a metal blade or edge such as Hollander beaters, conical refiners (Jordan, Claflin, Conflo, etc.), single and double disc refiners, etc., as shown in a book edited by Paulapuro (non-patent document 2).

As shown by the literature above, it is known that the characteristics of fibers beaten by these equipments are strongly influenced by the pulp consistency during the treatment.

When pulp is treated at high consistency (30-35% by weight), the fiber length does not significantly decrease by fiber breakage, but the resulting fibers contain high proportions of flexing of fibers called curl or bending of fibers called kink so that they have a low bonding ability. When pulp is treated at low consistency (2-6% by weight), however, flexing of fibers is reduced and internal fibrillation is promoted so that the resulting fibers have a high bonding ability and sheet strength is improved, but the bulk decreases. When pulp is treated at medium consistency (10-20% by weight), the resulting fibers have intermediate properties.

REFERENCES

Patent document 1: JPA No. Hei 4-185791.
Patent document 2: JPA No. Hei 4-202895.
Patent document 3: JPA No. Hei 3-269199.
Patent document 4: JPA No. Hei 3-124895.
Patent document 5: JPA No. Hei 5-230798.
Patent document 6: JPA No. Sho 58-24000.
Patent document 7: JPA No. Hei 4-370293.
Patent document 8: JPA No. Hei 11-350380.
Patent document 9: JPA No. Hei 7-189168.
Patent document 10: JPA No. Hei 7-54293.

Non-patent document 1: "Pulp and Paper, Chemistry and Chemical Technology", Volume 2, Japanese translation version by Reizaburo Oe and Makoto Usuda, Chugai Industry Research Group, 1984.

Non-patent document 2: H. Paulapuro ed. Papermaking Science and Technology, book 8, Papermaking Part 1, Stock Preparation and Wet End, Fapet Oy, Chapt. 3, 2000.

DISCLOSURE OF THE INVENTION

Problems to be Solved by the Invention

Noting that the bulk of pulp decreases most greatly by internal fibrillation during mechanical beating, we sought to promote external fibrillation while inhibiting damages to fibers and the progress of internal fibrillation by applying a load only on the surfaces of the fibers. Thus, we intended to obtain papers and sheets having low density, high surface quality, good size stability and high opacity by promoting external fibrillation while inhibiting the progress of internal fibrillation.

Means for Solving the Problems

We found that the problems above can be solved by cellulose-based fibrous materials characterized in that they have scale-like external fibrils that are different from those obtained by conventional beating methods.

ADVANTAGES OF THE INVENTION

Papers and sheets having low density, high surface quality, good size stability and high opacity can be obtained by using the cellulose-based fibrous materials having scale-like external fibrils of the present invention.

REFERENCES IN THE DRAWINGS

Figure 1:
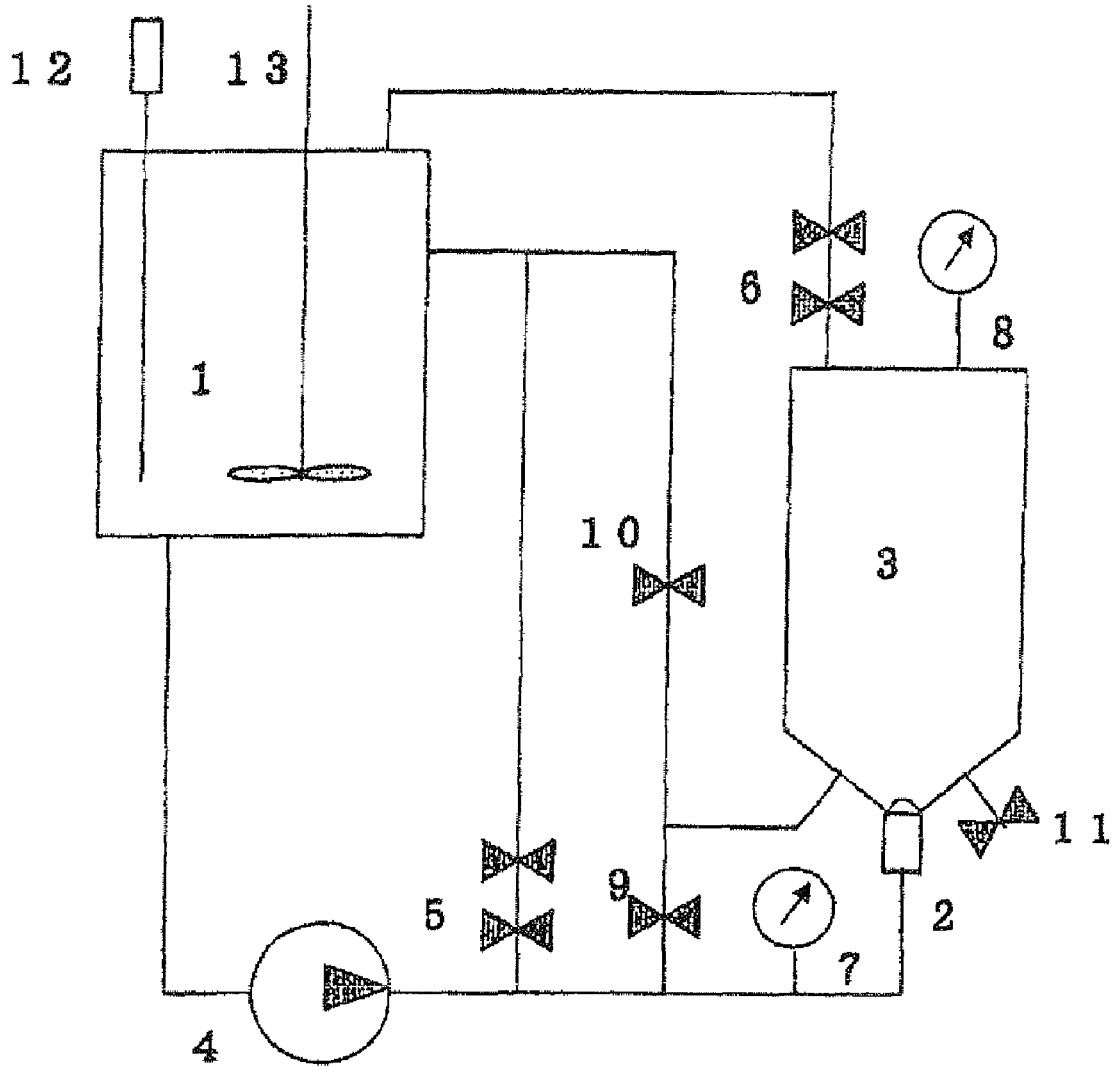
FIG. 1 is a schematic diagram showing the cavitation jet washer used in the examples.

1: sample tank
2: nozzle
3: cavitation jet cell
4: plunger pump
5: upstream pressure regulating valve
6: downstream pressure regulating valve
7: upstream pressure meter
8: downstream pressure meter
9: water feed valve
10: circulating valve
11: drain valve
12: temperature sensor
13: mixer.

THE MOST PREFERRED EMBODIMENTS OF THE INVENTION

The cellulose-based fibrous materials of the present invention refer to fibrous materials based on cellulose derived from wood or non-wood plants, e.g., wood-derived fibers including chemical pulp fibers such as kraft pulp and sulfite pulp of softwood and hardwood; mechanical pulp fibers such as groundwood pulp, refiner groundwood pulp, thermomechanical pulp and chemithermomechanical pulp of softwood and hardwood; and recycled pulp fibers derived from waste paper and cellulosic sheet-like materials; and non-wood plant-derived fibers including fibers of cotton, flax, kenaf, straw, *Broussonetia papyrifera, Edgeworthia chrysantha*, etc. Regenerated cellulose fibers such as rayon are also included.

According to a book of Isogai et al. (Akira Isogai: "Materials Chemistry of Cellulose", The University of Tokyo Press, p. 68, 2001), beating of pulp refers to a process in which a mechanical shear stress is applied to hydrated pulp fibers to form gaps between microfibrils within the pulp fibers (internal fibrillation) and to raise fibrils on the outer sides of the pulp fibers (external fibrillation), thereby increasing the specific surface area to improve swelling of the pulp fibers with water, and at the same time, partially cutting the fibers and generating fine fibers flaked off the outer peripheral faces of the fibers.

The beating process of pulp increases the bonding area between fibers formed during papermaking, thereby causing changes in various mechanical properties, optical properties and liquid absorption. However, when pulp fibers are observed at the molecular level, the molecular weight of cellulose decreases only slightly and the crystallinity is almost unchanged during the beating process. This is attributed to the fact that amorphous and hydrophilic hemicellulose moieties serve as cushion to absorb mechanical energy.

According to a book of Shimaji et al. (Ken Shimaji et al.: "Wood Tissue", Morikita Publishing, p. 55, 1076), external fibrils seen in wood pulp beaten by conventional methods are filamentous structures having a width of about 0.4 to 1 μm observable by light microscopy, while microfibrils are elemental structural units present in cell walls as an assembly of cellulose molecules having a width of about 9 to 37 nm.

On the other hand, the cellulose-based fibrous materials of the present invention are characterized in that they have scale-like external fibrils. The scale-like external fibrils refer to flakes or hairs on the surface of a fiber having a width of 3 μm or more, preferably similar to the width of the fiber and consisting of a wide layer formed of an assembly of the microfibrils aligned side by side, i.e., the microfibrils on the surface of the fiber wall are flaked while retaining a layer structure. They are also characterized by a thickness ranging from 90 angstroms to 2 μm. When a fiber is observed by electron microscopy, it is desirably observed in the dry state eliminating hydrogen bonding, but it is difficult to observe external fibrils with high precision because such fibrils would be attracted to the surface of the fiber by capillarity so that they would be difficult to discern if the fiber were simply dried.

The scale-like external fibrils in the present invention are characterized in that they are stained by a high molecular weight dye having a molecular weight of 10,000 or more. Dyes having a molecular weight of 10,000 or more include orange dyes such as CI Constitution nos. 40000 to 40006 including Direct Orange 15 (old Color Index (CI) no. 621, or CI Constitution no. 40002/3) as described in a literature of Simon et al. (F. L. Simons, Tappi Journal, 33 (7), 312 (1950)) and a literature of Xiaochun et al. (Y. Xiaochun et al., Tappi Journal, 78 (6), 175 (1995)), but they are not specifically limited so far as they can stain cellulose-based fibers.

According to the literature of Xiaochun et al., the dyes having a molecular weight of 10,000 or more described above are molecules having a hydrodynamic size of 5 nm or more as measured by light scattering and cannot permeate into pores of less than 5 nm present on the surfaces of pulp fibers. However, the dyes having a molecular weight of 10,000 or more described above can readily access and selectively stain fibrillated regions by adsorption to them because fibrils consisting of an assembly of microfibrils on the surfaces of pulp fibers are exposed outside the pulp fibers.

In order to optically highlight fibrillated regions, they can be observed with enhanced contrast by staining the entire fiber using a low molecular dye such as Direct Blue 1 (old Color Index (CI) no. 518, or CI Constitution no. 24410) or Direct Blue 4, 15, 22, or 151 as described in the literatures above. The low molecular dye is adsorbed to the entire fiber, but displaced by a high molecular dye having a higher bonding force. As a result, the fibrillated regions to which the high molecular dye (orange dye) can be adsorbed can be stained in orange while fiber pore regions to which the high molecular dye cannot be adsorbed can be stained with the low molecular dye (blue dye), whereby the fibrillated regions can be highlighted. Suitable low-molecular dyes contain 51% or more of molecules having a molecular weight of less than 10,000, preferably less than 2000, more preferably 300-1500.

In a single unit of the fibrous materials, the area ratio of the externally fibrillated part expressed by equation 2 below is preferably 20% or more and the peripheral length index of the externally fibrillated part expressed by equation 3 below is 1.5 or more. In the fibrous materials of the present invention, these values increase because the scale-like external fibrils have a greater surface area as compared with conventional fibrils.

Area ratio of externally fibrillated part (%)=[(area of externally fibrillated part)/(area of externally fibrillated part+total surface area of fiber)]×100 (equation 2).

Peripheral length index of externally fibrillated part=(peripheral length of externally fibrillated part+total peripheral length of fiber)/(total peripheral length of fiber) (equation 3)

The cellulose-based fibrous materials having scale-like external fibrils of the present invention, especially wood pulps are characterized in that they have a lower water retention value when compared with pulps with advanced internal fibrillation beaten by conventional methods at the same Canadian Standard Freeness. In the cellulose-based fibrous materials of the present invention, the relation between water retention value (Y) and Canadian Standard Freeness (X) is approximated by equation 1 below. In pulps beaten by conventional methods, the value of a in equation (1) is greater than −0.22.

$Y=aX+b$, where $-0.22 \leqq a \leqq -0.01$, $150 \leqq b \leqq 300$ (Equation 1).

It is thought that the Canadian Standard Freeness reflects water retention of the entire fiber and the water retention value reflects water retention within the fiber. Thus, the pulps of the present invention have a lower water retention value when compared with pulps beaten by conventional methods at the same Canadian Standard Freeness because internal fibrillation has been less advanced. It should be noted that the water retention value is determined by the method defined in JAPAN TAPPI No. 26:2000.

The cellulose-based fibrous materials having scale-like external fibrils of the present invention can be obtained by any method, but they can be readily obtained by using methods promoting external fibrillation by shear force and collapse energy of cavitation bubbles such as cavitation jet treatment (JPA 2003-283957) rather than mechanical beating.

More specifically, the cavitation jet treatment refers to a method comprising actively introducing bubbles generated by cavitation into a suspension of a cellulose-based fibrous material and contacting the bubbles with the fibrous material, thereby promoting external fibrillation of the fibrous material by the impact force induced by collapse of the fine bubbles while suppressing internal fibrillation to adjust the freeness. The fibrous material can also be externally fibrillated by combining the cavitation jet treatment with mechanical beating.

The reason why external fibrillation is promoted by collapse energy of cavitation bubbles may be explained as follows. When fine bubbles generated by cavitation collapse, a strong energy is produced at a local region on the order of several micrometers, as described above. Thus, when fine bubbles or bubble clouds collapse at or near the surface of a cellulose-based fibrous material, the impact force arrives at the fiber surface directly or via liquid and becomes absorbed into an amorphous region of cellulose forming the fiber, thereby inducing external fibrillation and swelling of the fiber. The bubbles are very small relative to the fiber so that the impact force is not so strong to damage the entire fiber. Moreover, the fiber absorbs excessive energy as kinetic energy of the fiber per se even if a very strong impact force is induced by continuous collapse of bubble clouds because the fiber is dispersed in liquid but not fixed. Thus, it is thought that damages such as fragmentation of the fiber can be reduced and internal fibrillation can be suppressed as compared with beating methods based on mechanical action.

Means for generating cavitation in the present invention include, but not limited to, using a liquid jet, an ultrasonic transducer, a combination of an ultrasonic transducer and a horn amplifier, and laser irradiation. Methods using a liquid jet are preferred and more effective for cellulose-based fibrous materials because cavitation bubbles are efficiently generated and cavitation bubble clouds having a stronger impact force of collapse are formed. The cavitation generated by the methods described above is clearly different from the uncontrollably harmful cavitation spontaneously generated in conventional fluid machinery.

When cavitation is generated by a liquid jet in the present invention, a suspension of a cellulose-based fibrous material can be contacted with bubbles by emitting the suspension of the cellulose-based fibrous material as the liquid jet. The fluid forming the liquid jet can be any of liquids, gases and solids such as powder or cellulose-based fibrous materials or mixtures thereof so far as it is in the fluid state. If necessary, the fluid can be combined with another fluid as a fresh fluid. The fluid and the fresh fluid may be jetted as a homogeneous mixture or separately jetted.

The liquid jet refers to a jet of a liquid or a fluid containing solid particles or a gas dispersed or mixed in a liquid, including a liquid jet containing a slurry of a cellulose-based fibrous material or inorganic particles and bubbles. The gas here may include bubbles generated by cavitation.

The flow rate and pressure are especially important because cavitation occurs when a liquid is accelerated and a local pressure becomes lower than the vapor pressure of the liquid. Therefore, the basic dimensionless number expressing a cavitation state, Cavitation Number σ is defined as follows (New Edition Cavitation: Basics and Recent Advance, Written and Edited by Yoji Katoh, Published by Makishoten, 1999).

$$\sigma = \frac{p_\infty - p_v}{\frac{1}{2}\rho U_\infty^2} \quad (1)$$

where $p_8$: pressure of normal flow, $U_8$: flow rate of normal flow, $p_v$: vapor pressure of fluid, ρ: density of fluid.

If the cavitation number here is high, it means that the flow site is under a condition hard to generate cavitation. Especially when cavitation is generated through a nozzle or an orifice tube as in the case of a cavitation jet, the cavitation number σ can be rewritten by the following equation (2) where $p_1$: nozzle upstream pressure, $p_2$: nozzle downstream pressure, $p_v$: saturated vapor pressure of sample water, and the cavitation number a can be approximated as shown in the following equation (2) in the case of a cavitation jet because of the large pressure difference between $p_1$, $p_2$ and $p_v$ expressed as $p_1 \gg p_2 \gg p_v$ (H. Soyama, J. Soc. Mat. Sci. Japan, 47 (4), 381 1998).

$$\sigma = \frac{p_2 - p_v}{p_1 - p_2} \cong \frac{p_2}{p_1} \quad (2)$$

Cavitation conditions in the present invention are as follow: the cavitation number a defined above is desirably 0.001 or more and 0.5 or less, preferably 0.003 or more and 0.2 or less, especially 0.01 or more and 0.1 or less. If the cavitation number σ is less than 0.001, little benefit is attained because the pressure difference between the cavitation bubbles and the surroundings is small when they collapse, but if it is greater than 0.5, cavitation is less likely to occur because the pressure difference in the flow decreases.

When a jetting liquid is emitted via a nozzle or an orifice tube to generate cavitation, the pressure of the jetting liquid (upstream pressure) is desirably 0.01 MPa or more and 30 MPa or less, preferably 0.7 MPa or more and 15 MPa or less, especially 2 MPa or more and 10 MPa or less. If the upstream pressure is less than 0.01 MPa, little benefit is attained because a pressure difference is less likely occur from the downstream pressure. If it is greater than 30 MPa, cost problems arise because special pumps and pressure vessels are required and energy consumption increases. On the other hand, the pressure in the vessel (downstream pressure) is preferably 0.05 MPa or more and 0.3 MPa or less expressed in static pressure. The ratio between the pressure in the vessel and the pressure of the jetting liquid is preferably in the range of 0.001-0.5.

The jet flow rate of the jetting liquid is desirably in the range of 1 m/sec or more and 200 m/sec or less, preferably in the range of 20 m/sec or more and 100 m/sec or less. If the jet flow rate is less than 1 m/sec, little benefit is attained because the pressure drop is too small to generate cavitation. If it is greater than 200 m/sec, however, cost disadvantages occur because high pressure is required and therefore, a special equipment is required.

The site where cavitation is generated in the present invention can be selected from, but not limited to, the inside of any vessel such as a tank or the inside of a pipe. The treatment can be a one-pass operation, but the effect can be further enhanced by repeating a necessary number of cycles. The treatment can be performed in parallel or in series using multiple generating means.

A liquid jet for generating cavitation may be emitted in a vessel open to the atmosphere such as a pulper, but preferably within a pressure vessel to control cavitation.

In the method for generating cavitation by a liquid jet in the present invention, the liquids that can be jetted to the target suspension of a cellulose-based fibrous material include, but not limited to, tap water, recycled water recovered during papermaking processes, pulp drain water, white water, and the suspension of a cellulose-based fibrous material itself. Preferably, the suspension of a cellulose-based fibrous material itself is jetted to provide a greater benefit because not only cavitation is generated around the jet but also a hydrodynamic shear force is obtained when the jet is emitted from a nozzle or an orifice at a high pressure.

The solids content of the target suspension of a cellulose-based fibrous material in which cavitation is to be generated by a liquid jet is preferably 5% by weight or less, more preferably 4% by weight or less, still more preferably 0.1-3% by weight in terms of the bubble generating efficiency. When the solids content of the target liquid is 5% by weight or more and 20% by weight or less, a benefit can be attained by adjusting the consistency of the jetting liquid to 4% by weight or less.

The pH of the suspension of a cellulose-based fibrous material is preferably pH 1-13, more preferably pH 3-12, still more preferably pH 4-11. If the pH is less than 1, problems such as corrosion of equipments occur, which are disadvantageous in terms of materials and maintenance or the like. If the pH exceeds 13, however, alkaline discoloration of cellulose fibers occurs to unfavorably lower brightness. Alkaline pH conditions are more desirable because cellulose fibers are highly swollen and more OH active radicals are produced.

According to the present invention, the flow rate of the jetting liquid increases by increasing the jetting pressure of the liquid, resulting in a pressure drop and generation of stronger cavitation. Moreover, the vessel receiving the target liquid is pressurized to increase the pressure in the region where cavitation bubbles collapse, resulting in an increase in the pressure difference between bubbles and the surroundings, whereby bubbles vigorously collapse with a stronger impact force. Cavitation is influenced by the amount of gas in the liquid, and if the gas is excessive, bubbles collide with each other and join together to create a cushioning effect so that the impact force of collapse is absorbed by other bubbles and the impact force decreases. Thus, the treating temperature is preferably 0° C. or more and 70° C. or less, especially 10° C. or more and 60° C. or less in view of the influence of dissolved gas and vapor pressure. Considering that the impact force is normally maximal at the midpoint between the melting point and the boiling point, temperatures around 50° C. are preferred in the case of aqueous solutions, though high effects can be obtained even at lower temperatures within the range defined above because there is no influence of vapor pressure.

According to the present invention, the energy required for generating cavitation can be reduced by adding a surfactant. Surfactants that are used include, but not limited to, known or novel surfactants, e.g., nonionic surfactants, anionic surfactants, cationic surfactants and ampholytic surfactants such as fatty acid salts, higher alkyl sulfates, alkyl benzene sulfonates, higher alcohols, alkyl phenols, alkylene oxide adducts of fatty acids, etc. These may be added as single components or mixtures of two or more components. They may be added in any amount necessary for lowering the surface tension of the jetting liquid and/or target liquid.

The cellulose-based fibrous materials having scale-like external fibrils of the present invention can be used to prepare bulky papers because the fibers are stiff and bulky with little damage within the fibers. The papers can be prepared by using known paper machines under any condition not specifically defined. Paper machines that can be used include Fourdrinier paper machines, twin-wire paper machines and the like. Multilayer paper and paperboard can be prepared by using cylinder paper machines.

Papers can be prepared by using the cellulose-based fibrous materials having scale-like external fibrils of the present invention alone or in combination with conventional chemical pulps (bleached softwood kraft pulp (NBKP) or unbleached kraft pulp (NUKP), bleached hardwood kraft pulp (LBKP) or unbleached kraft pulp (LUKP), etc.), mechanical pulps (groundwood pulp (GP), thermomechanical pulp (TMP), chemithermomechanical pulp (CTMP), etc.), and deinked pulp (DIP) as a single component or a mixture at any ratio. The pH during the papermaking process may be acidic or neutral or alkaline.

Papers containing a cellulose-based fibrous material having scale-like external fibrils of the present invention (hereinafter referred to as papers of the present invention) can contain fillers. Fillers that can be used include known fillers such as white carbon, silica, talc, kaolin, clay, ground calcium carbonate, precipitated calcium carbonate, titanium oxide, synthetic resin fillers, etc.

The papers of the present invention can further contain aluminum sulfate, sizing agents, paper strength enhancers, yield improvers, freeness improvers, colorants, dyes, antifoaming agents and the like, if desired.

The papers of the present invention can be used as printing papers uncoated or coated with a pigment-free finishing agent. The printing papers of the present invention are desirably coated with a finishing agent based on a water-soluble polymer for the purpose of improving surface strength or sizing performance. Suitable water-soluble polymers include conventional finishing agents such as starches, oxidized starches, modified starches, carboxymethyl cellulose, polyacrylamide, polyvinyl alcohol, etc. alone or as mixtures thereof. In addition to the water-soluble polymers described above, the finishing agents can also contain paper strength enhancers designed to improve water resistance or surface strength and external sizing additives designed to provide sizing performance. The finishing agents can be applied with coaters such as two-roll size press coaters, gate roll coaters, blade metering coaters, rod metering coaters, etc. The finishing agents are preferably applied in an amount of 0.1 $g/m^2$ or more and 3 $g/m^2$ or less per side.

The papers of the present invention can be used as not only printing papers and newsprint papers but also specialty papers for communication, converting papers, sanitary papers, etc. Specialty papers for communication more specifically include electrophotographic transfer paper, inkjet recording paper, business form paper, etc. Converting papers more specifically include base paper for release paper, industrial laminate paper, base paper for molded paper, etc. Sanitary papers more specifically include facial tissue, toilet tissue, paper towels, etc. They can also be used as paperboard such as base paper for corrugated fiberboard.

The papers of the present invention can also be used as base papers for papers having pigment-containing coating layers such as coated papers, specialty papers for communication, converting papers, etc. Coated papers more specifically include coated art paper, medium weight coated paper, lightweight coated paper, cast-coated paper, white paperboard, etc. Specialty papers for communication more specifically include electrophotographic transfer paper, inkjet recording paper, heat sensitive recording paper, pressure sensitive recording paper, etc. Converting papers more specifically include base paper for release paper, wrapping paper, backing paper for wall paper, release paper, base paper for molded paper, etc.

The papers of the present invention can also be used as base paper for laminated paper having one or more synthetic resin layers on either one side or both sides.

EXAMPLES

The following examples further illustrate the present invention without, however, limiting the invention thereto.

Example 1

A sample (raw material A) was collected from the inlet of a beater (double disc refiner from Aikawa Iron Works Co.) in the finishing step of a bleached hardwood kraft pulp prepared in factory A. Raw material A was adjusted to a desired freeness by using a cavitation jet washer shown in FIG. 1 at a jetting liquid pressure (upstream pressure) of 7 MPa (jet flow rate 70 m/sec.) and a pressure in the target vessel (downstream pressure) of 0.3 MPa. A pulp suspension having a consistency of 1.1% by weight was used as a jetting liquid to treat the pulp suspension (consistency 1.1% by weight) in the vessel by cavitation.

Comparative Example 1

Raw material A was treated in the beater of Example 1 to give raw material B at the outlet of the beater.

Figure 2:
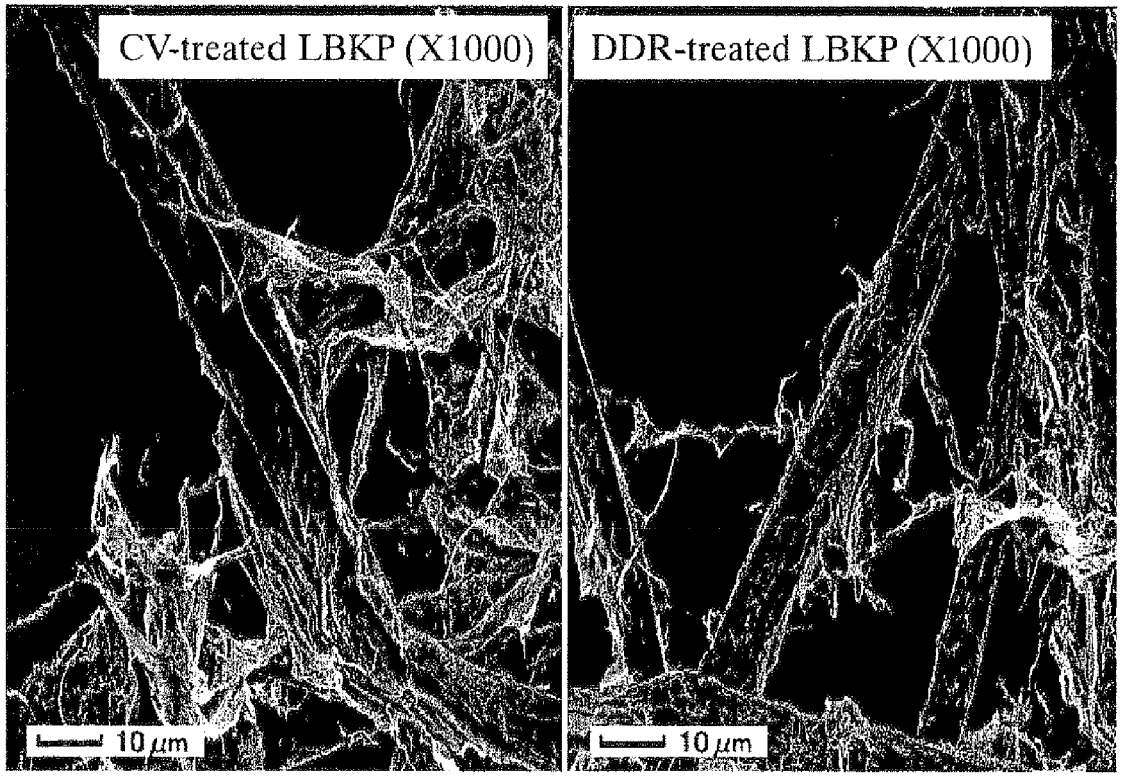
FIG. 2 shows electron microphotographs (1,000× magnification) of the kraft pulp fibers obtained in Example 1 and Comparative example 1.
Figure 3:
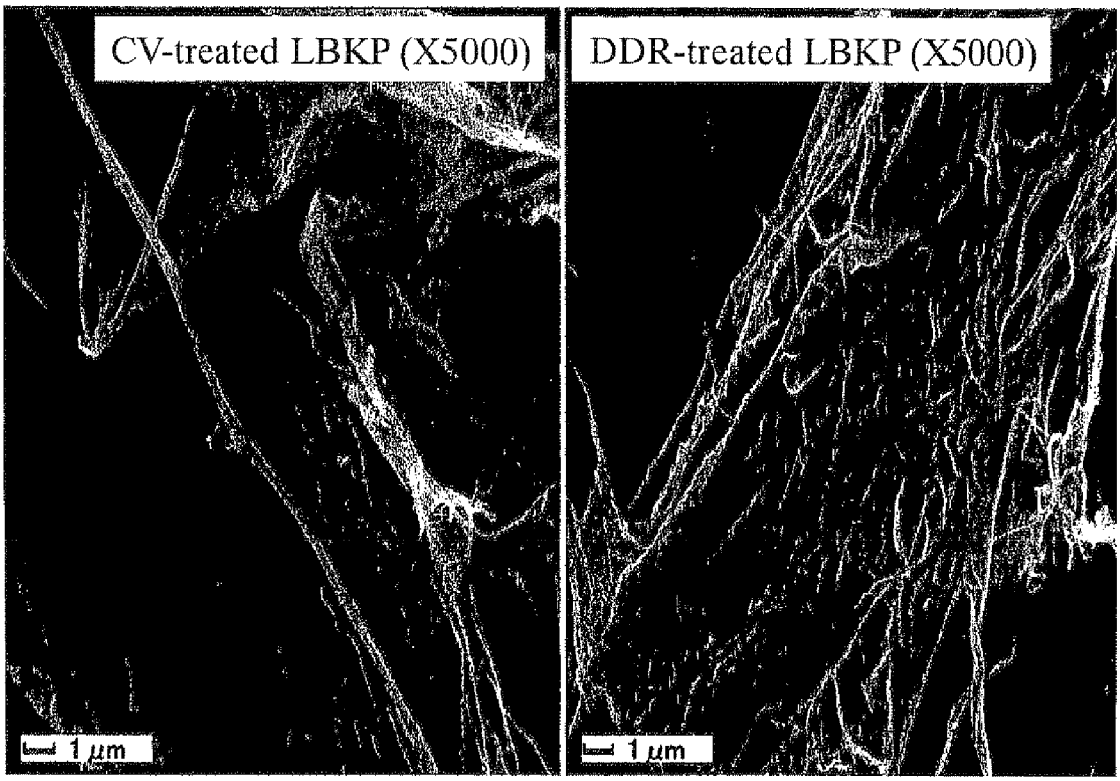
FIG. 3 shows electron microphotographs (5,000× magnification) of the kraft pulp fibers obtained in Example 1 and Comparative example 1.
Figure 4:
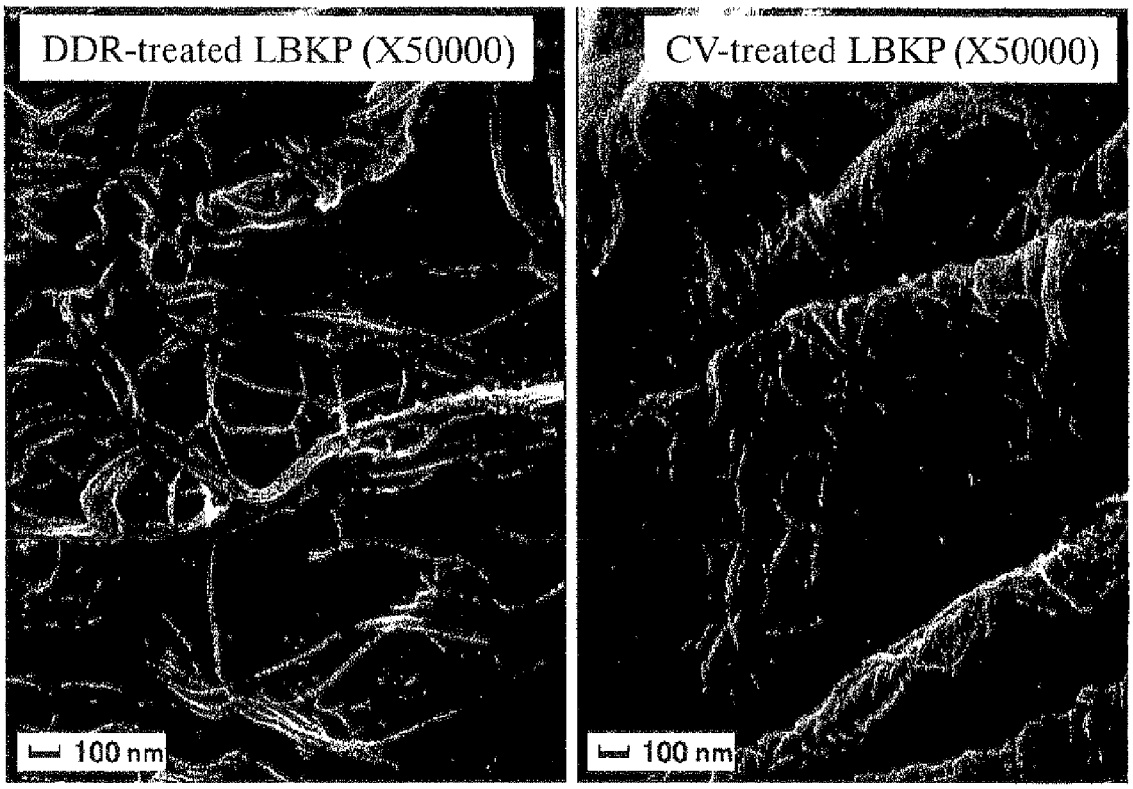
FIG. 4 shows electron microphotographs (50,000× magnification) of the kraft pulp fibers obtained in Example 1 and Comparative example 1.

The slurries containing pulp fibers of Example 1 and Comparative example 1 were dried by solvent displacement while the fibers were swollen without hydrogen bonding as described in a literature of Stone et al., and electron microphotographs (1000×; 5,000×; 50,000× magnification) were taken and shown in FIGS. 2 to 4.

FIG. 2 shows microphotographs of the fibers at 1,000× magnification. In Comparative example 1, filamentous hairs called fibrils appear on the fiber surfaces, whereas the fiber surfaces are entirely shaved in Example 1. This corresponds to an assembly of microfibrils flaked in the form of scales on the fiber surfaces.

FIG. 3 shows electron microphotograph at 5,000× magnification. In Comparative example 1, a myriad of small hairs appear on the fiber surfaces and the fiber walls are damaged, resulting in a disordered structure. In Example 1, however, microfibrils are regularly flaked in the form of scales and the underlying fiber walls suffer little damages, thus showing an ordered structure.

FIG. 4 shows electron microphotograph at 50,000× magnification. In Comparative example 1, microfibrils appear to be broken on the fiber surfaces. In Example 1, however, microfibrils are dense and show an ordered structure.

Example 2

A dry sheet of a bleached hardwood kraft pulp prepared in factory B was disintegrated at low consistency and beaten to a Canadian Standard Freeness (CSF) of 566 ml using a Niagara beater to give raw material C. Raw material C was further treated by using a cavitation jet washer in the same manner as described in Example 1 to a Canadian Standard Freeness of 331 ml.

Comparative Example 2

Raw material C was treated in the Niagara beater described above to a Canadian Standard Freeness of 345 ml to give a sample of Comparative example 2.

Figure 5:
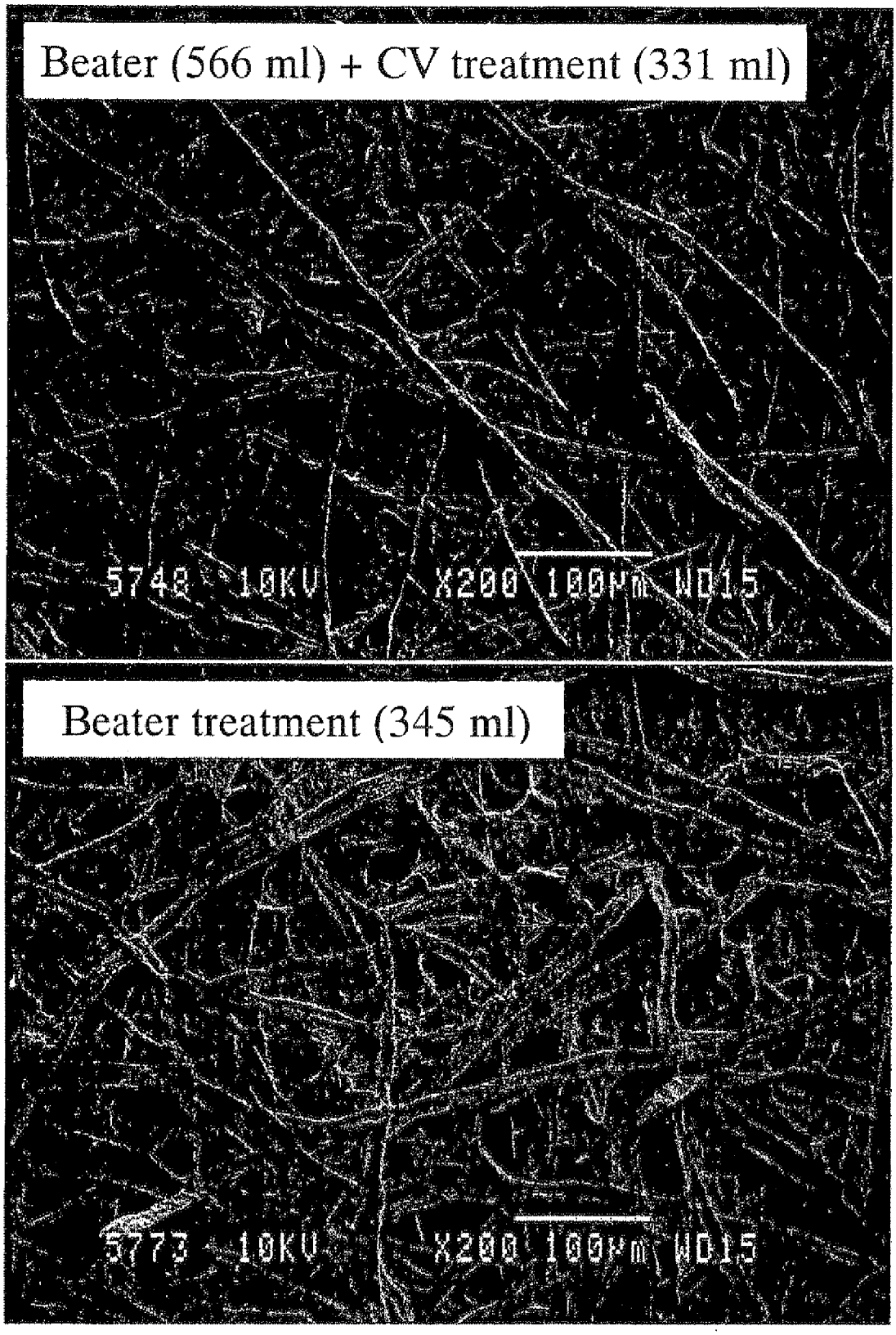
FIG. 5 shows electron microphotographs (200× magnification) of the handsheets obtained in Example 2 and Comparative example 2.

Handsheets were prepared from the slurries containing pulp fibers of Example 2 and Comparative example 2 according to JIS P 8222:1998, and electron microphotographs (200× magnification) of the sheet surfaces were taken and shown in FIG. 5.

As shown in FIG. 5, the fibers of Comparative example 2 contained many kinks or twists, curls and the like, and they were flat. At the same time, visible gaps existed between fibers. However, the fibers of Example 2 were relatively long and straight and less flattened so that they retained their bulk. Moreover, the gaps between fibers were small.

Example 3

A dry sheet of a bleached hardwood kraft pulp prepared in factory B was disintegrated at low consistency and beaten to a Canadian Standard Freeness (CSF) of 566 ml using a Niagara beater to give raw material 1. Raw material C was treated in a Niagara beater to a CSF of 448 ml to give raw material 2, to a CSF of 345 ml to give raw material 3, and to a CSF of 247 ml to give raw material 4. These raw materials 1 to 4 were treated by using a cavitation jet washer in the same manner as described in Example 1 to give pulps of cavitation (CV) treatments 1 to 4. In CV treatments 1 and 2, the number of cavitation treatment cycles was varied to prepare samples having varying Canadian Standard Freenesses.

Comparative Example 3

Raw materials 1 to 4 in Example 3 were used in Comparative example 3.

Comparative Example 4

Raw material C was treated in a PFI mill to a Canadian Standard Freeness of 159 ml to give a sample of Comparative example 4.

Figure 6:
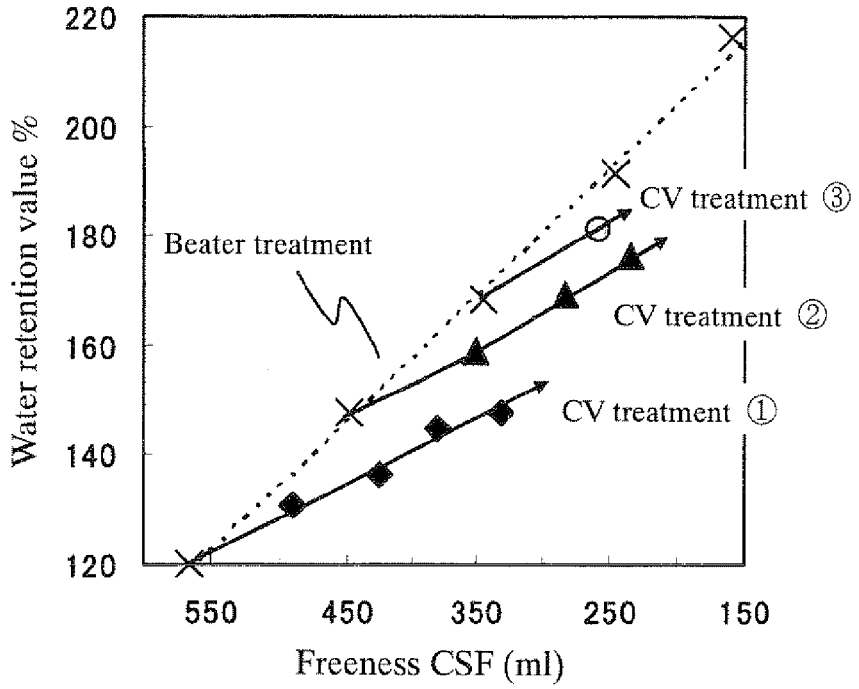
FIG. 6 is a graph showing the relationship between the freeness and the water retention value of the kraft pulps obtained in Example 3 and Comparative example 3.

FIG. 6 shows the relationship between the water retention value (determined by the method defined in JAPAN TAPPI No. 26: 2000) and the Canadian Standard Freeness of the pulps obtained in Example 3, Comparative example 3 and Comparative example 4. At the same Canadian Standard Freeness, the water retention values of the pulps obtained by cavitation treatment were lower than those obtained by beater treatment. The relation between Canadian Standard Freeness (Y) and water retention value (X) is approximated by equation 1 below when the freeness decreases. Table 1 shows a and b determined from FIG. 6. In the pulps of CV treatments 1 to 4, a was in a range of −0.01 to −0.22.

$$Y=aX+b, \text{ where } -0.22 \leqq a \leqq -0.01,\ 150 \leqq b \leqq 300 \qquad \text{(Equation 1)}$$

Handsheets were prepared from the pulps of Example 3 (CV treatments 1-4) and Comparative examples 3 and 4 according to JIS P 8222:1998. The handsheets were measured for thickness and basis weight by the methods described below and their density was calculated therefrom. The handsheets were further tested for breaking length and tensile breaking elongation, tear index, Oken smoothness, Oken gas permeation resistance, ISO opacity, and specific scattering coefficient by the methods described below.

Paper thickness: measured according to JIS P 8118: 1998.

Basis weight: measured according to JIS P 8124: 1998 (ISO 536: 1995).

Density: calculated from the measured value of the thickness and basis weight of each handsheet.

Breaking length and tensile breaking elongation: measured according to JIS P 8113: 1998.

Tear index: measured according to JIS P 8116: 2000.

Oken smoothness, Oken gas permeation resistance: measured by an Oken smoothness/air permeability tester according to JAPAN Tappi Paper and Pulp Test Method No. 5-2:2000.

ISO opacity: measured according to JIS P 8149: 2000.

Specific scattering coefficient: measured by a colorimeter (from Murakami Color Research Laboratory Co., Ltd.) according to TAPPI T425om-91.

Pulp sheets were also prepared according to JIS P 8222: 1998 except that the sheets were prepared in circulating white water to efficiently yield fine fibers and allowed to stand to dryness over the diel cycle under standard conditions defined in JIS P 8111:1998 without using any drying plate or ring, and tested for post-immersion elongation after 60 minutes according to Japan TAPPI Paper and Pulp Test Method No. 27A. Higher values show that the sheets elongated in water to higher extents.

Figure 7:
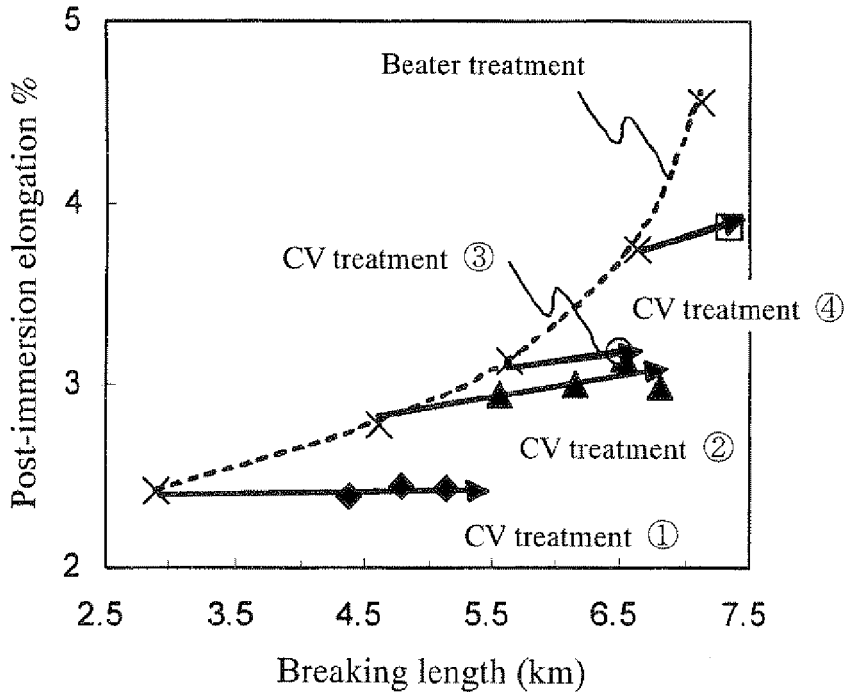
FIG. 7 is a graph showing the relationship between the breaking length and the post-immersion elongation of the handsheets obtained in Example 3 and Comparative example 3.

FIG. 7 summarizes the relationship between breaking length and post-immersion elongation as an indicator of size stability. At the same breaking length, the post-immersion elongations of pulp sheets obtained by CV treatment were lower than those obtained by beater treatment, thus showing improved size stability.

The results of paper quality tests are summarized in Table 2. CV treatments 1 to 4 in the Example gave pulp sheets having low density, good surface quality and high specific scattering coefficient.

TABLE 1

| | | Number of treatment cycles | CSF (ml) | Water retention value (%) | a in equation 1 | b in equation 1 |
|---|---|---|---|---|---|---|
| Example 3 | CV treatment 1 | 3 | 490 | — | −0.119 | 188 |
| | | 4 | 425 | 136.5 | | |
| | | 7 | 380 | 144.8 | | |
| | | 10 | 331 | 147.7 | | |
| | CV treatment 2 | 1 | 350 | 158.8 | −0.165 | 218 |
| | | 3 | 283 | 169.1 | | |
| | | 5 | 235 | 176.5 | | |
| | | 10 | 136 | 199.9 | | |
| | CV treatment 3 | 1 | 259 | 181.0 | −0.146 | 219 |
| | CV treatment 4 | 1 | 176 | 208.3 | −0.124 | 190 |
| Comparative example 3 | Raw material 1 | — | 566 | 120.2 | −0.232 | 251 |
| | Raw material 2 | — | 448 | 147.8 | | |
| | Raw material 3 | — | 345 | 168.5 | | |
| | Raw material 4 | — | 247 | 191.2 | | |
| Comparative example 4 | | — | 159 | 216.5 | −0.233 | 262 |

TABLE 2

| | | Number of treatment cycles | Basis weight ($g/m^2$) | Paper thickness (μm) | Density ($g/m^3$) | Breaking length (km) | Elongation (%) | Tear index ($mN \cdot m^2/g$) | Smoothness (sec) | Gas permeation resistance (sec) | Opacity (%) | Specific scattering coefficient ($m^2/kg$) |
|---|---|---|---|---|---|---|---|---|---|---|---|---|
| Example 3 | CV treatment 1 | 3 | 60.7 | 106 | 0.575 | 3.90 | 1.95 | 4.2 | 32 | 4 | 77.6 | 40.2 |
| | | 4 | 60.3 | 102 | 0.590 | 4.38 | 2.02 | 5.7 | 40 | 6 | 77.3 | 39.9 |
| | | 7 | 61.8 | 102 | 0.604 | 4.79 | 2.18 | 6.2 | 56 | 10 | 77.3 | 38.5 |
| | | 10 | 60.1 | 97 | 0.617 | 5.14 | 2.62 | 5.7 | 64 | 13 | 76.3 | 37.9 |
| | CV treatment 2 | 1 | 61.1 | 95 | 0.644 | 5.56 | 2.70 | 6.5 | 82 | 17 | 75.8 | 36.3 |
| | | 3 | 61.2 | 92 | 0.667 | 6.15 | 2.84 | 7.1 | 119 | 43 | 75.2 | 34.4 |
| | | 5 | 62.3 | 91 | 0.687 | 6.53 | 2.93 | 7.0 | 155 | 69 | 75.4 | 33.4 |
| | | 10 | 61.3 | 88 | 0.700 | 6.80 | 2.79 | 7.3 | 258 | 222 | 73.9 | 31.5 |
| | CV treatment 3 | 1 | 60.3 | 87 | 0.697 | 6.49 | 3.00 | 6.9 | 160 | 75 | 73.4 | 32.5 |
| | CV treatment 4 | 1 | 60.7 | 82 | 0.737 | 7.34 | 3.31 | 7.3 | 342 | 254 | 71.3 | 28.8 |
| Comparative example 3 | Raw material 1 | — | 60.6 | 113 | 0.538 | 2.90 | 1.35 | 3.9 | 20 | 1 | 78.3 | 41.8 |
| | Raw material 2 | — | 61.6 | 101 | 0.612 | 4.62 | 2.41 | 5.9 | 46 | 6 | 76.6 | 37.3 |
| | Raw material 3 | — | 59.3 | 90 | 0.659 | 5.64 | 2.90 | 6.8 | 85 | 16 | 73.7 | 34.0 |

TABLE 2-continued

| | Number of treatment cycles | Basis weight ($g/m^2$) | Paper thickness (μm) | Density ($g/m^3$) | Breaking length (km) | Elongation (%) | Tear index ($mN \cdot m^2/g$) | Smoothness (sec) | Gas permeation resistance (sec) | Opacity (%) | Specific scattering coefficient ($m^2/kg$) |
|---|---|---|---|---|---|---|---|---|---|---|---|
| Raw material 4 | — | 59.5 | 84 | 0.710 | 6.63 | 3.38 | 6.5 | 181 | 62 | 72.1 | 31.2 |
| Comparative example 4 | — | 59.7 | 79 | 0.752 | 7.13 | 3.40 | 6.8 | 310 | 228 | 69.5 | 27.8 |

Example 4

The pulps of CV treatment 1 in Example 3 were tested for the area ratio and the peripheral length index of the externally fibrillated part by the procedure shown below. The results are shown in Table 3.

1. Screen the pulps for long fibers (42 meshes on) for use as samples.
2. Wash the long pulp fibers in distilled water.
3. Stain the long pulp fibers with stain solutions (orange dye (PONTAMINE FAST ORANGE 6RN): blue dye (Direct Blue-1)=0.2:1).
4. Wash the stained long pulp fibers in distilled water.
5. Dehydrate the long pulp fibers by suction onto a filter to prepare test sheets.
6. Dry the test sheets, and then take photographs of the long pulp fibers using Ultra-deep Color 3D Profile Measuring Microscope (trade name: VK-9500 Generation II from Keyence). Here, externally fibrillated regions are stained in orange and the fibers are stained in blue.
7. Select an externally fibrillated fiber in the microphotographs of the fibers and calculate the area of the externally fibrillated part, the area of the fiber part, the peripheral length of the externally fibrillated part and the peripheral length of fiber part using an image analysis/processing software (particle analysis application VK-H1G9 attached to the microscope above). Calculate the area ratio of the externally fibrillated part by equation 2 below, and calculate the peripheral length index of the externally fibrillated part by equation 3 below.

Area ratio of externally fibrillated part (%)=[(area of externally fibrillated part)/(area of externally fibrillated part+total surface area of fiber)]×100 (equation 2)

Peripheral length index of externally fibrillated part=(peripheral length of externally fibrillated part+total peripheral length of fiber)/(peripheral length of fiber) (equation 3)

Comparative Example 5

The pulps of raw materials 2 to 4 were tested for the area ratio of the externally fibrillated part and the peripheral length index of the externally fibrillated part in the same manner as described in Example 4, and the results are shown in Table 3.

TABLE 3

| | | Number of treatment cycles | CSF (ml) | Area ratio of externally fibrillated part (%) | Peripheral length index of externally fibrillated part |
|---|---|---|---|---|---|
| Example 4 | CV treatment 1 | 3 | 490 | 24.1 | 1.79 |
| | CV treatment 1 | 7 | 380 | 28.9 | 1.75 |

TABLE 3-continued

| | | Number of treatment cycles | CSF (ml) | Area ratio of externally fibrillated part (%) | Peripheral length index of externally fibrillated part |
|---|---|---|---|---|---|
| | CV treatment 1 | 10 | 331 | 30.5 | 2.02 |
| Comparative example 5 | Raw material 2 | — | 448 | 7.6 | 1.37 |
| | Raw material 3 | — | 345 | 15.4 | 1.53 |
| | Raw material 4 | — | 247 | 18.0 | 1.75 |

As shown in Table 3, both of the area ratio and the peripheral length index of the externally fibrillated part per fiber in the pulp fibers treated by cavitation in Example 4 increased as compared with the pulp fibers treated by a beater in Comparative example 5.

Example 5

A dry sheet of a bleached hardwood kraft pulp prepared in factory C was disintegrated at low consistency and beaten to a Canadian Standard Freeness (CSF) of 520 ml to give raw material 5. Raw material 5 was treated in a beater (double disc refiner from Aikawa Iron Works Co.) to a CSF of 320 ml to give raw material 6 and to a CSF of 200 ml to give raw material 7. Raw material 5 was treated in a cavitation jet washer in the same manner as described in Example 1 to give a pulp of cavitation (CV) treatment. The number of cavitation treatment cycles was varied to prepare samples having varying freenesses. In the same manner as described in Example 4, the area ratio of the externally fibrillated part and the peripheral length index of the externally fibrillated part were determined, and the results are shown in Table 4.

Comparative Example 6

Raw materials 6, 7 of Example 5 were tested for the area ratio of the externally fibrillated part and the peripheral length index of the externally fibrillated part in the same manner as described in Example 4, and the results are shown in Table 4.

TABLE 4

| | | Number of treatment cycles | CSF (ml) | Area ratio of externally fibrillated part (%) | Peripheral length index of externally fibrillated part |
|---|---|---|---|---|---|
| Example 5 | CV treatment 1 | 10..5 | 420 | 29.7 | 2.05 |
| | CV treatment 1 | 21 | 340 | 28.4 | 2.27 |
| Compar- | Raw | — | 320 | 10..9 | 1.41 |

TABLE 4-continued

| | | Number of treatment cycles | CSF (ml) | Area ratio of externally fibrillated part (%) | Peripheral length index of externally fibrillated part |
|---|---|---|---|---|---|
| ative | material 6 | | | | |
| exam- | Raw | — | 200 | 16.7 | 1.68 |
| ple 6 | material 7 | | | | |

As shown in Table 4, both of the area ratio and the peripheral length index of the externally fibrillated part per fiber in the pulp fibers treated by cavitation in Example 5 increased as compared with the pulp fibers treated by a double disc refiner in Comparative example 6.

Thus, these results suggested that pulp fibers having wide scale-like external fibrils could be obtained by cavitation treatment.

The invention claimed is:

1. A cellulose-based fibrous material having an assembly of microfibrils having a width of 3 μm or more and a thickness of 9 nm to 2 μm as external fibrils.

2. The cellulose-based fibrous material of claim 1, wherein the external fibrils consist of an assembly of microfibrils is capable of being absorbed with a dye having a molecular weight of 10,000 or more.

3. The cellulose-based fibrous material of claim 1, wherein the fibrous material consists of a chemical pulp fiber selected from the group consisting of softwood, hardwood and mixtures thereof.

4. The cellulose-based fibrous material of claim 1, wherein the fibrous material consists of a mechanical pulp fiber selected from the group consisting of softwood, hardwood and mixtures thereof.

5. The cellulose-based fibrous material of claim 1, wherein the fibrous material consists of a recycled pulp fiber derived from waste paper.

6. The cellulose-based fibrous material of claim 1, wherein the fibrous material consists of a non-wood pulp fiber.

7. The cellulose-based fibrous material of claim 1, wherein the relation between Canadian Standard Freeness (X) and water retention value (Y) is approximated by equation 1 below:

$$Y=ax+b, \text{ where } -0.22 \leqq a \leqq -0.01,\ 150 \leqq b \leqq 300 \qquad \text{(Equation 1).}$$

8. The cellulose-based fibrous material of claim 1, wherein the area ratio of an externally fibrillated part expressed by equation 2 below is 20% or more:

$$\text{Area ratio of externally fibrillated part (\%)}=[(\text{area of externally fibrillated part})/(\text{area of externally fibrillated part}+\text{total surface area of fiber})]\times 100 \qquad \text{(equation 2).}$$

9. The cellulose-based fibrous material of claim 1, wherein the peripheral length index of an externally fibrillated part expressed by equation 3 below is 1.5 or more:

$$\text{Peripheral length index of externally fibrillated part}=(\text{peripheral length of externally fibrillated part}+\text{total peripheral length of fiber})/(\text{total peripheral length of fiber}) \qquad \text{(equation 3).}$$

10. The cellulose-based fibrous material having an assembly of microfibrils having a width of 3 μm or more and a thickness of 9 nm to 2 μm as external fibrils which assembly is obtained by treating a suspension of a fibrous material by contacting bubbles generated by cavitation in the suspension with the fibrous material.

11. A paper containing the cellulose-based fibrous material having an assembly of microfibrils having a width of 3 μm or more and a thickness of 9 nm to 2 μm as external fibrils.

* * * * *